United States Patent [19]

Hinson

[11] 4,348,023

[45] Sep. 7, 1982

[54] RACKET SPORTS TRAINING AID

[76] Inventor: Robin A. Hinson, 11602 Ashbury, Cleveland, Ohio 44106

[21] Appl. No.: 213,000

[22] Filed: Dec. 4, 1980

[51] Int. Cl.[3] ..... A63B 69/38

[52] U.S. Cl. ..... 273/29 A; 273/75

[58] Field of Search ..... 273/29 A, 26 C, 166, 273/161 A, 67 D, 72, 73 R, 75, 73 J

[56] References Cited

U.S. PATENT DOCUMENTS 3,957,267 5/1976 Vitalo ..... 273/26 C 4,098,503 7/1978 Antone ..... 273/26 C

*Primary Examiner*—Richard C. Pinkham

*Assistant Examiner*—T. Brown

*Attorney, Agent, or Firm*—Meyer, Tilberry & Body

[57] ABSTRACT

A training aid is constructed of a number of force spreading pads interconnected by a strap to hold a racket in proper position and enforce proper grip. A finger pad, grip pad, heel pad and wrist pad are applied around the hand and a racket is inserted and gripped. The strap is tightened, restraining the hand and racket in proper relationship for play and instruction.

9 Claims, 5 Drawing Figures

RACKET SPORTS TRAINING AID

The present invention pertains to the art of racket sports and, more particularly, to a device for training the proper grip of rackets used in these sports and maintaining the proper grip.

One of the most important and fundamental lessons in instructing regarding racket sports, including tennis, racquetball and other sports, is the proper grip. Only after the proper grip is explained to the student and mastered can instructions regarding stroke techniques, forehands, backhands and strategy be properly carried out.

Proper grip is absolutely essential for the execution of proper forehand strokes and backhand strokes in tennis. An improper grip will make proper stroking impossible and also causes the player to tire much more rapidly, interfering with his enjoyment of the sport.

In the past, instruction in proper grip has always started with a very careful illustration of the proper method of wrapping the hand about the racket grip based on a general formula with the heel of the hand. This normally results in the proper grip being applied. Many times the student will unconsciously shift his hand in preparation for a stroke or during a stroke thereby losing the proper grip. This results in quick tiring of the hand and forearm. Also, the racket is held at an incorrect angle for proper stroking. Instructors have tried to remedy this situation by inspecting the grip after stroking and in emphasizing the importance of proper grip.

Some implements have been designed in the past to aid in maintaining the proper grip during actual stroking. U.S. Pat. No. 4,209,169 to Roberts illustrates such a device. Roberts teaches the use of a wrist strap connected to a collar on the racket handle by a pliable tether. This device limits the maximum angle between the racket and the forearm. The device does not aid in holding the hand in proper position regarding the rest of the grip. The player is still free to twist his hand around the axis of the racket or perpendicular to the axis of the racket to an improper grip. Moreover, the device does not aid in maintaining the grip around the racket, preventing fatique.

THE INVENTION

The present invention contemplates a new and improved training aid which overcomes all of the above referred to problems and others and provides a training aid which enforces the proper grip of a sports racket while the racket is in use.

In accordance with the present invention, a gripper is provided having a wrist pad, finger pad, grip pad and strap interconnected with one another and interacting with the player's hand in a manner which enforces the proper grip of a tennis racket or other racket during actual stroking of the racket.

Further in accordance with the invention, a heel pad is provided which is interposed between the heel of the hand and the base of a racket and held in position by the strap to prevent blistering during play or training.

Yet further in accordance with the invention, the gripper strap is made adjustable such that it can tightly hold the racket between the grip pad and the hand of the player and one gripper will fit all size hands.

OBJECTS

The principal object of the present invention is the provision of a gripper which will enforce the proper grip of a tennis or other sport racket while the racket is in use.

A further object of the present invention is to provide a gripper which will train the hand to automatically assume the proper grip of a tennis or other racket sport racket such that the gripper itself may be dispensed with after a sufficient amount of practice.

It is yet another object of the present invention to provide a gripper which not only trains the proper grip but strengthens the grip such that players with weak wrist or forearm muscles may play tennis or other racket sports without quickly tiring.

It is yet another object of the present invention to provide a gripper which teaches the proper grip, strengthens the proper grip and also prevents the formation of blisters from prolonged racket sport play.

DRAWINGS

The invention may take physical form in certain parts and arrangements of parts, a preferred embodiment of which will be described in detail in this specification and illustrated in the accompnaying drawings which form a part hereof and wherein.

PREFERRED EMBODIMENT

Figure 1:
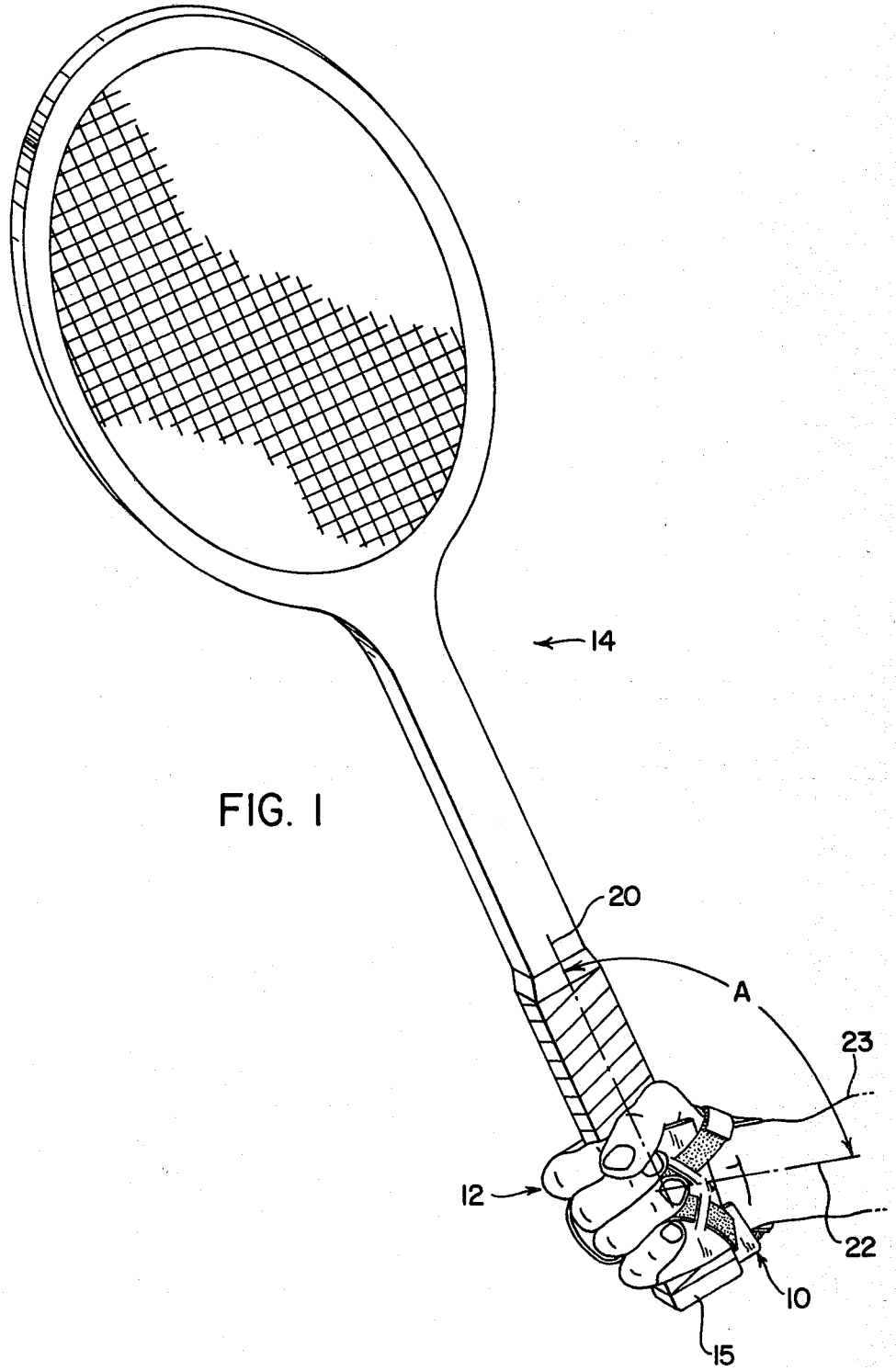
FIG. 1 is a perspective view of a right hand gripping a tennis racket with the aid of the present invention.

Referring now to the drawings wherein the showings are for the purpose of illustrating the preferred embodiment of the invention only and not for the purposes of limiting same, FIG. 1 shows the gripper 10 of the present invention as worn on a person's right hand 12 and aiding in the proper grip of a tennis racket 14. It can be seen in FIG. 1 and FIG. 3 that, in the proper grip of tennis racket 14, the bottom of the tennis racket 15 rests against the heel 16 of the hand and the axis 20 of the tennis racket forms an obtuse angle A with the axis 22 of the forearm 23. The fingers 25 are wrapped around the racket handle in planes which are not perpendicular to the axis of the handle and the thumb 26 is laid across the handle generally alongside the forefinger. The skewed angle of the planes of the fingers 25 adds to the obtuse angle between the axis of the tennis racket 20 and the axis of the forearm 22. This grip is nearly universally accepted as the best grip for serving and forehand strokes.

Figure 2:
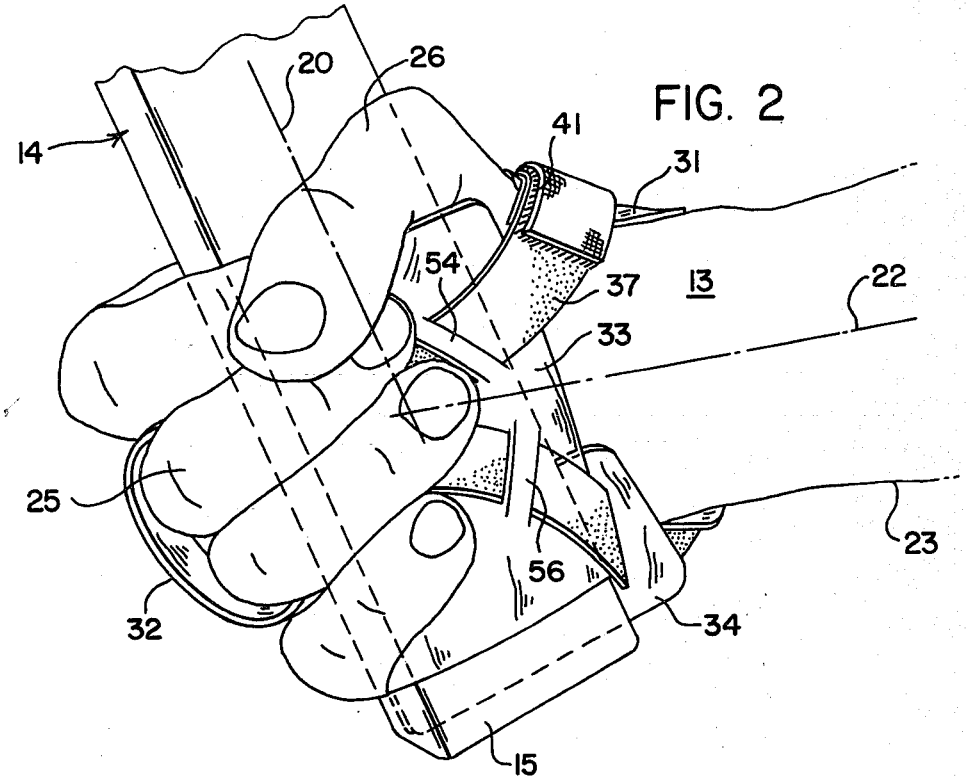
FIG. 2 is a detailed view of the right hand gripping the tennis racket in FIG. 1.
Figure 3:
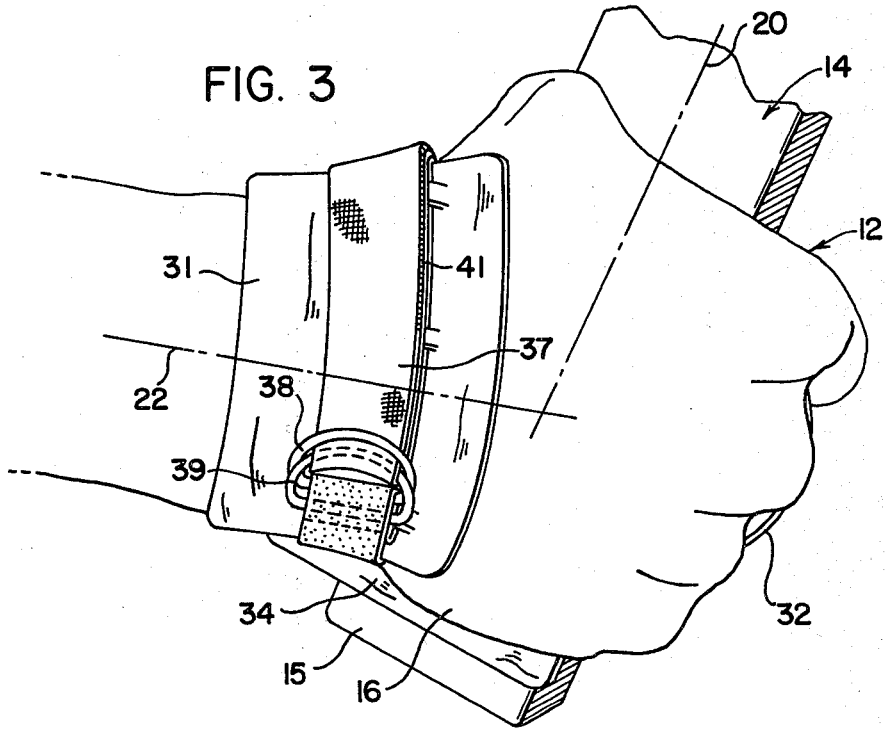
FIG. 3 is a rear view of the hand gripping the tennis racket in FIG. 2.

The gripper can be seen in FIG. 2 and FIG. 3 as it aids in maintaining the grip. The various elements of the gripper can be best seen in FIG. 4 and FIG. 5 and will first be described before described their interaction.

Four pads are provided in the construction of the present gripper. A wrist pad 31, a finger pad 32, a grip pad 33 and a heel pad 34. The pads are preferably fabricated from leather which provides superior gripping ability and attractive appearance.

The four pads are interconnected by a strap 37. The two ends of the strap are fastened together by double cinch rings 38, 39 and a Velcro pad area 40 and hook area 41 disposed on the opposite end of the strap from the cinch rings.

A strap extension 45 is provided at the cinch ring end of the strap 37. Strap extension 45 passes through three loops or bands 46, 47, 48 attached to the wrist pad thereby fixing the wrist pad 31 to the strap extension 45. A loop or band 51 is also provided on the heel pad 34 fastening it to the strap 37 near the double cinch rings 38, 39. Four loops or bands 53, 54, 55, 56 are provided in the grip pad 33 and oriented so as to provide fastening for two segments of strap 37 crossing one another over the back of grip pad 33. Two loops or bands 60, 61 are also provided on the finger pad 32 for fastening to strap 37.

Figure 4:
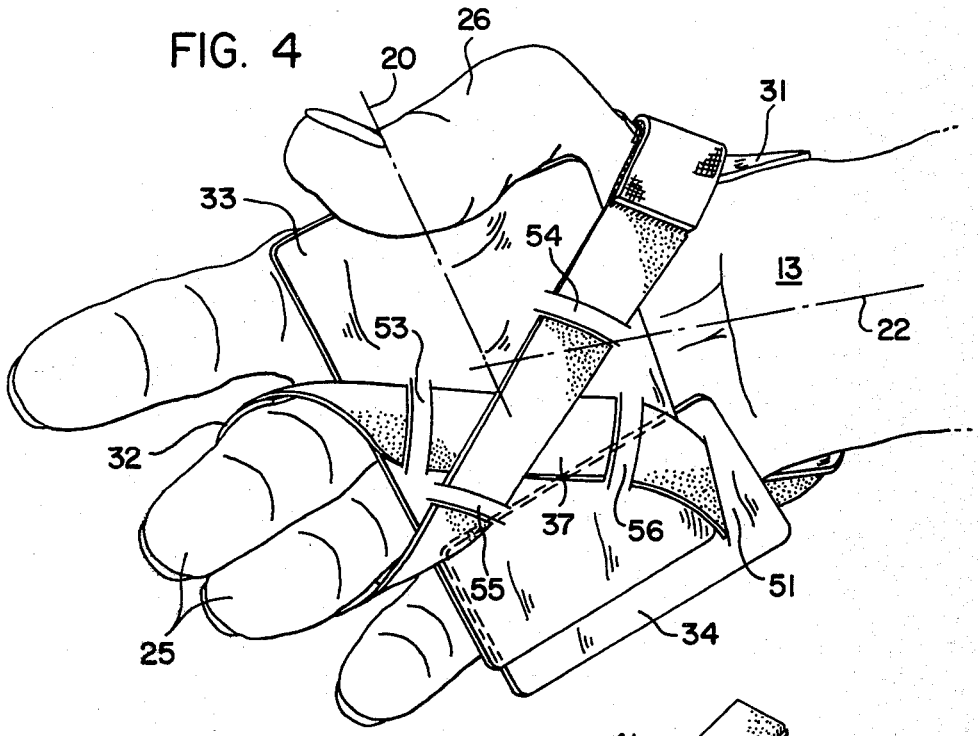
FIG. 4 is a front view of an open right hand with the gripper applied to the hand prior to insertion of a tennis racket; and, FIG. 5 is a view of the gripper prior to application to a hand.
Figure 5:
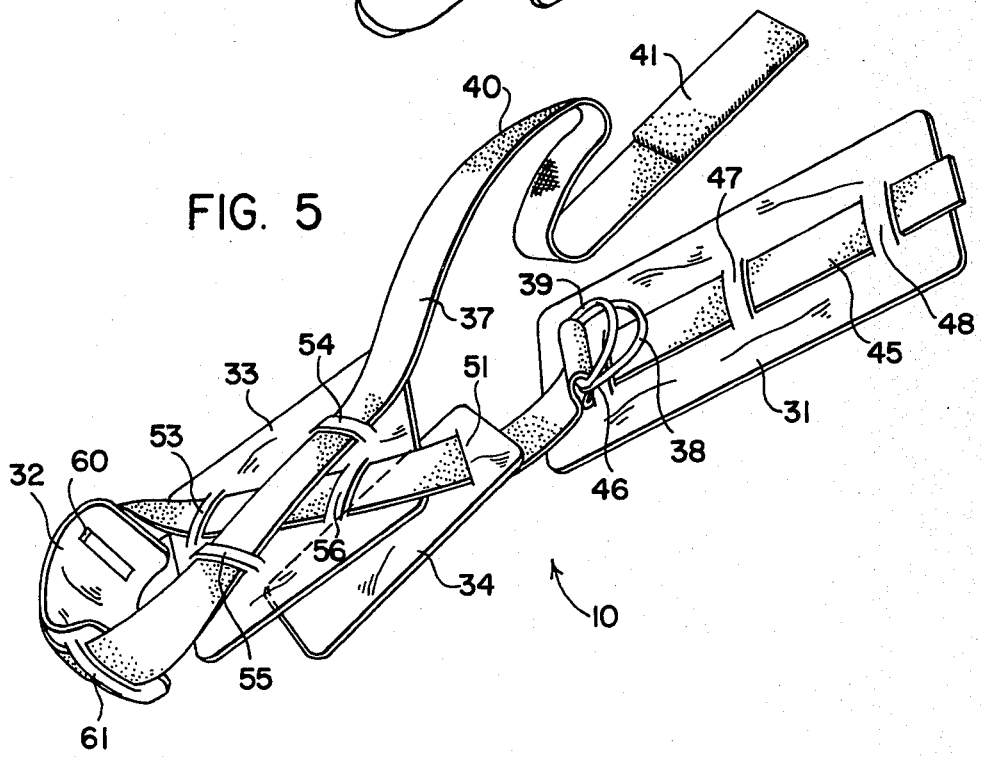

The interaction of all these pads and the strap 37 to aid in gripping can best be seen in FIG. 2, FIG. 3 and FIG. 4. Although all of the elements of the gripper 10 are not fully visible in any one figure, the interaction is clear. Finger pad 32 is disposed over the second and third fingers of the right hand providing a large bearing area for strap 37 which encircles the fingers and is fastened to pad 32. Strap segments come between the forefinger and the second finger and the third finger and little finger and proceed to the grip pad 33 where they pass through bands 53, 54, 55, 56 and cross. Exiting grip pad 33, the strap 37 encircles the wrist 13 engaging the wrist pad 31 on the back of the wrist. The end of the strap on which Velcro pad 40 and hook 41 are disposed is passed through at least one of the three wrist pad bands 46, 47, 48 and engaged to the double cinch ring 38, 39. The heel pad 34 is disposed on the strap at a point near the wrist such that the heel pad extends over the heel 16 of the hand protecting it from the rubbing action of the racket 14 during strokes and preventing blisters.

FIG. 4 illustrates the gripper 10 after it is applied to the hand as described above but prior to gripping a racket. The racket 14 is next inserted between the gripper pad 33 and the palm of the hand and the heel pad 34 is placed between the bottom end of the racket 15 and the heel of the hand 16. The proper grip is applied to the racket and the strap 37 tightened and fastened with the cinch rings 38, 39 and Velcro hooks and pad 40, 41.

Strap 37 is under tension forcing grip pad 33 against racket 14. Thwe finger pad 32 holds the fingers against the racket 14 and prevents the fingers from unwinding, loosening the grip. With the racket restrained in the hand and the hand held in its proper grip, the user can now start to play. The proper grip will be maintained while the gripper is in use. This prevents excess strain and quick tiring associated with improper grip. Further, because the tension of the strap holds the fingers tight and aids in the grip, the arm and hand tires less quickly and the user may play for a longer period of time.

The bands used to fasten each pad to the strap add to the utility of this training aid by allowing the easy adjustment of the position of each pad on the strap 37. This makes adjustment of the training aid for different size hands not only possible but easy. Further, because the band fastening means allows disassembly of the training aid, the heel pad can be moved from one strap segment to another, allowing use by left-handed players.

In practice, the gripper 10 is assembled and properly sized by adjusting the Velcro hooks and pad 40, 41 during its first use. Thereafter, it is only slightly loosened, not disconnected, for removal. It can then be slipped on like a glove and tightened for subsequent use.

Having thus described my invention, I claim:

1. A racket sports training aid for improving the grip adapted to engage a player's wrist, hand, fingers and racket comprised of a wrist pad, a finger pad, a grip pad and strap; said strap interconnecting said wrist pad, said finger pad and said grip pad such that; said finger pad engages said fingers, said strap connects to said finger pad and passes away from said finger pad in two strap segments, a first strap segment passing from said fingers toward said wrist and a second strap segment passing from said fingers toward said wrist; said first strap segment and said second strap segment connect to said grip pad; said first strap segment adapted to pass near the heel of the hand and around said wrist and engage said wrist pad; said second strap segment adapted to pass near the base of the thumb of said hand and about said wrist engaging said first strap segment and said wrist pad; the engagement of said first strap segment and said second strap segment being adjustable such that said two strap segments may be varied in length and said grip pad is adapted to press against said racket when said two strap segments are shortened aiding in the proper grip of said racket.

2. The training aid of claim 1 wherein said first strap segment is adapted to pass between the forefinger and second finger of a user's hand and said second strap segment is adapted to pass between the little finger and third finger of a user's hand.

3. The training aid of claim 2 wherein said first strap segment and said secnd strap segment cross one another in the vicnity of said grip pad.

4. The training aid of claim 3 including a heel pad connected to said first strap segment near the heel of the hand adapted to be positioned between the heel of the hand and said racket protecting the hand from irritation from racket.

5. The training aid of claim 3 wherein said grip pad is provided with four bands retaining said two strap segments in slidable connection with said grip pad in a crossing relationship.

6. The training aid of claim 5 wherein said wrist pad is provided with at least two bands; said second strap segment is provided with at least one cinch ring fixed to said second strap segment, said second strap segment is provided with a strap extension extending beyond said cinch ring and connected to said wrist pad by said wrist strap bands and said first strap segment is adapted to pass through at least one of said wrist pad bands and said cinch ring and fasten to itself.

7. The training aid of claim 6 wherein said first strap segment is provided with a Velcro pad and hooks.

8. The training aid of claim 7 wherein said finger pad is provided with two bands slidably retaining said finger pad on said strap.

9. The training aid of claim 8 wherein said second strap segment is provided with two cinch rings fixed to said second strap segment at the same position.

* * * * *